United States Patent [19]

Luhr et al.

[11] 4,304,360

[45] Dec. 8, 1981

[54] XEROGRAHIC TONER MANUFACTURE

[75] Inventors: Robert J. Luhr; Ernesto Marti, both of Boulder, Colo.

[73] Assignee: International Business Machines Corporation, Armonk, N.Y.

[21] Appl. No.: 108,766

[22] Filed: Dec. 31, 1979

[51] Int. Cl.[3] ..... B02C 19/06

[52] U.S. Cl. ..... 241/5; 241/19; 241/79.1; 241/80

[58] Field of Search ..... 241/5, 19, 24, 39, 40, 241/79.1, 80

[56] References Cited

U.S. PATENT DOCUMENTS

| | | | |
|---|---|---|---|
| 2,846,150 | 8/1958 | Work | 241/5 |
| 3,150,943 | 9/1964 | Darrow et al. . | |
| 3,166,510 | 1/1965 | West et al. . | |
| 3,413,776 | 12/1968 | Vytlacil . | |
| 3,426,513 | 2/1969 | Bauer . | |
| 3,636,682 | 1/1972 | Rush . | |
| 3,675,858 | 7/1972 | Stephanoff | 241/39 X |
| 3,741,485 | 6/1973 | Gage et al. | 241/5 X |
| 3,932,194 | 1/1976 | Lamar et al. | 241/5 X |
| 3,960,734 | 6/1976 | Zagorski . | |
| 4,149,861 | 4/1979 | Sogo et al. . | |

OTHER PUBLICATIONS

"Preparation of Powders . . . ", by Crowley et al., in Journal of Paint Technology, vol. 44, No. 571, Aug., 1972, pp. 56–67.

*Primary Examiner*—Howard N. Goldberg
*Attorney, Agent, or Firm*—Francis A. Sirr

[57] ABSTRACT

A method of manufacturing xerographic toner to achieve upper and lower particle size classification by first grinding large pellets of toner material in a jet mill. Upper particle size classification is achieved by then passing the ground material to a coarse classifier which operates to return relatively large particles to the jet mill for further grinding, and supplies the finer particles, which are generally no larger than 13 to 15 microns in diameter, to a cyclone separator. In the cyclone separator, the length of the cyclone's exit duct is controlled to achieve lower particle size classification by causing particles below a generally 5 micron diameter size to exit the separator as waste material by way of its upper exit duct. The finished product exits the cyclone by way of the cyclone's lower output port.

5 Claims, 1 Drawing Figure

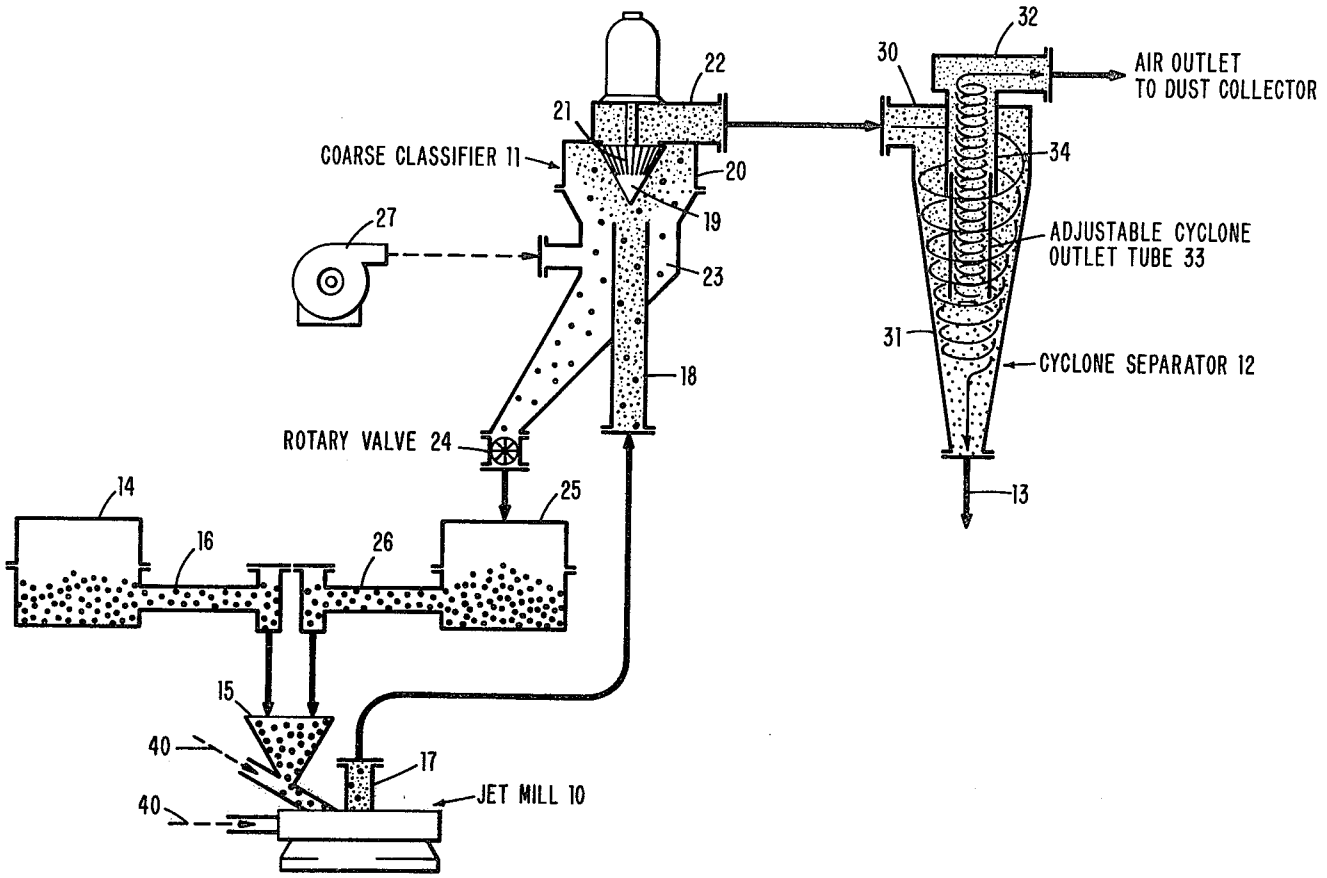
AIR OUTLET
TO DUST COLLECTOR
ADJUSTABLE CYCLONE
OUTLET TUBE 33
CYCLONE SEPARATOR 12
32
34
13
30
31
22
20
19
23
18
21
COARSE CLASSIFIER 11
27
ROTARY VALVE 24
25
26
16
14
15
17
JET MILL 10
40
40

XEROGRAHIC TONER MANUFACTURE

DESCRIPTION

1. Technical Field

The present invention relates to the field of xerographic toner and to a method of manufacturing the same.

2. Related Patent Applications

Copending United States Patent application Ser. No. 848,173, filed Nov. 3, 1977 by J. J. Abbott et al, for "Xerographic Toner" is incorporated herein by reference. This application describes a toner which is exemplary of toner which can be manufactured in accordance with the present invention. Specifically, the toner of this copending application is of a particle size classification wherein less than 15% by weight are greater than 16 microns, from 7 to 15% by weight are less than 5 microns, the remainder are from 5 to 16 microns, and the median particle size by weight being from 8 to 12 microns.

Copending United States Patent application Ser. No. 960,138, filed Nov. 13, 1978 by J. J. Abbott et al, for "Electrophotographic Toner and Carrier" is incorporated herein by reference. This application describes a synergistic mixture of particle size classified toner, as described in above-mentioned copending application Ser. No. 848,173, with carrier beads having a core which is coated with a mixed resin system of PTFE, FEP and PAI.

BACKGROUND OF THE INVENTION

As evidenced by the prior art, and the above-noted copending applications, the advantage of using size-classified toner in a xerographic device is well known.

Prior construction and arrangement for manufacturing size-classified toner has provided at least two separate means for achieving classification at the high and low ends, respectively, of the desired particle size distribution range. Thereafter, the now-classified toner was supplied to a cyclone separator whereat the toner was collected, and incidentally the very small particles were discarded as waste with the cyclone's output airstream.

The efficiency of a cyclone separator is generally defined as the ability of the separator to discharge only air as waste. The increasing presence of particles in the air-waste output of the separator is a direct measure of decreasing separator efficiency.

In the art of cyclone separators per se various means have been employed to control this efficiency, usually to maximize efficiency, or to achieve special results from the separator.

As exemplary, U.S. Pat. Nos. 3,150,943 and 3,960,734 modify the separator's top-disposed outlet tube, and the former adds clean air to minimize the discharge of dust and thereby maximize dust collection.

In U.S. Pat. No. 3,636,682 the cyclone's outlet pipe is constructed and arranged relative the inlet pipe to produce high efficiency in a dust collecting environment. U.S. Pat. No. 3,413,776 suggests that cyclone separation performance is improved by use of a bundle of tubes located within the main outlet tube. In U.S. Pat. No. 3,426,513 the length of the separator's outlet tube is required to be of sufficient length to allow a whirling air of gas column to develop, when used to filter incoming air for an internal-combustion engine.

U.S. Pat. No. 4,149,861 suggests that separation of fines from a gaseous stream is enhanced by a concentric, multi-section exit pipe of increasing length from the inner to the outer concentric pipes.

The above-noted U.S. patents are incorporated herein by reference to indicate the state of the art relative cyclone separators per se.

SUMMARY OF THE INVENTION

The construction and arrangement of the present invention provides an improved method for producing dual-size-classified toner, specifically by the use and adjustment of a cyclone separator to achieve the lower-size-classification of the toner, simultaneously with the collection of the method's end product.

More specifically, toner which has been large-size-classified is supplied, by way of a gaseous carrier, to a cyclone separator, and the separator's exit duct length is adjusted to decrease the separator's efficiency so that toner particles smaller than desired exit the separator as waste through its top-disposed exit duct. Generally speaking, and without limitation thereto, the longer the duct length, i.e. the further down into the cyclone's conical tower the duct is adjusted, the larger the particle size which will be eliminated from the end product.

The large size end of the size classification range is achieved by first grinding toner pellets, for example in a jet mill, then coarse-classifying to the desired large size, and finally returning particles larger than this size to the jet mill for further grinding.

The foregoing and other features and advantages of the invention will be apparent from the following more particular description of a preferred embodiment of the invention, as illustrated in the accompanying drawing.

BRIEF DESCRIPTION OF THE DRAWING

The single FIGURE is a schematic representation of the best mode of the present invention and will enalbe those skilled in the art to make and use the same.

DESCRIPTION OF THE PREFERRED EMBODIMENT

With reference to the FIGURE, the primary means by which the method of the present invention is accomplished are jet mill 10, coarse classifier 11, and cyclone separator 12. The method's output, i.e. dual-classified toner, exits the process at 13.

The input to the method comprises relatively large, cylindrical toner pellets of an exemplary 0.0625 inch in diameter and 0.125 inch in length, present in hopper 14. These pellets are screw-fed to the jet mill's input hopper 15 using a volumetric screw feeder 16.

The preparation and composition of such toner pellets is well known to those of skill in the art and forms no part of the present invention. Suffice it to say that desired constituents are mixed, heated and then extruded as a molten spaghetti-like material, which quickly solidifies, and is then chopped into toner pellets by a whirling knife.

Compressed air 40 is introduced into mill 10 via a manifold of twelve tangentially oriented nozzles, at an exemplary 1300 cubic feet per minute (CFM) and 100 pounds per square inch (PSI). This results in high-impact collisions among the toner pellets. In a time period of approximately one minute, the pellets are broken down to finer particles and pass out through centrally-disposed mill outlet duct 17 and into coarse classifier 11.

The classfier's incoming material stream 18 is pneumatically directed upward toward the bottom of cone-shaped rotor 19 having radial fins 21. This rotor rotates at an exemplary speed of 550 revolutions per minute (RPM) and functions to accelerate the larger particles of stream 18 to the classifier's annular wall 20. Finer particles of stream 18, i.e. those particles which satisfy a predetermined largest particle size of dual classified toner 13, and an exemplary 13 to 15 micron size, migrate through the rotor's fins 21 with the rising air stream, and pass out of the separator by way of exit duct 22.

The larger than desired toner particles, and thus heavy particles, fall down through chamber 23. A rotary valve 24 is continuously operated to supply these particles to hopper 25 whereat screw feeder 26 is operable to feed these particles back to jet mill 10 for further grinding.

Secondary air is supplied to classifier 11 by way of blower 27. In an exemplary arrangement, this air is at 1.0 PSI and 600 CFM.

As is well known, the largest particle size exiting classifier 11 at duct 22 is controlled by the speed of rotor 19 and the secondary airflow induced by fan 27. For example, to reduce the size of particle exiting at duct 22, one would increase the speed or rotor 19 and/or decrease the airflow (CFM) induced by fan 27.

The output 22 of the coarse classifier is directed to the inlet duct 30 of the cyclone separator. This separator performs its usual function of separating particles from the conveying air stream, and in addition the separator is constructed and arranged to achieve the smallest desired particle size classification of dual classified toner 13, i.e. an exemplary 5 micron size.

In a cyclone separator, the airflow path is generally a double vortex. Air spirals downward at the outside walls 31 of the cyclone, and upward in its center. When air enters the cyclone at duct 30, its generally linear velocity undergoes a redistribution so that the tangential component of velocity increases with decreasing radius from the cyclone's center line of symmetry, this center line being generally coincident with 13. This velocity component approaches zero at its conical wall 31, allowing the larger particles, i.e. larger than the exemplary 5 microns, to settle by gravity, while smaller particles are pulled out of the cyclone by the upward airstream and discarded as waste through upper-disposed outlet duct 32. Preferably, duct 32 connects to a dust collector, not shown.

The fines classification to the exemplary 5 micron small particle size end of the desired dual classification range is achieved by vertical height adjustment of the bottom edge of the cyclone's two-piece outlet tube 33, 34.

In an exemplary arrangement according to the present invention, the feed rate of toner material to jet mill 10 was 240 LBS/HR, the mill operated at 3300 RPM, and rotor 19 operated at 550±50 RPM. The pressure under which toner material was fed to the jet mill was 95 PSI, the pressure of compressed air source 16 was 950 CFM at 90 PSI, and that of secondary air source 27 was 600 CFM at 1.0 PSI.

Experimental results, showing the effect in small particle size variation at output 13 by the use of tube 33 extending beyond the end of fixed-position tube 34 were as follows:

| | Median Particle Size | % Less Than 5 Micron by Number |
|---|---|---|
| No extension | 14.1 to 15.1 micron | 51 to 53% |
| 12 inch extension | no change | 48.6 to 50.2% |
| 22 inch extension | no change | 48.5 to 49.5% |
| 36 inch extension | no change | 23.3 to 27.5% |
| 28 inch extension | no change | 44.1 to 45.7% |
| 30 inch extension | no change | 41.5 to 43.9% |

In this manner, a 30 inch extension, whereby tube 33 effectively lowers the bottom end of fixed-position tube 34 by 30 inches, was selected in order to comply with a material specification requiring 40%±5% of the particles by number be less than 5 microns in size.

While a preferred embodiment of the invention has been described, it is to be understood that the present invention is not limited to this precise disclosure, and that the invention is defined by the scope of the appended claims.

What is claimed is:

1. A method of manufacturing dual classified xerographic toner, within a particle size range spanned by a desired large-size particle and a desired small-size particle, from grossly larger toner pellets, comprising the steps of:

subjecting said toner pellets to a grinding step which produces toner particles whose size ranges from a largest size of substantially said desired large-size particle classification and a smallest size which includes particles finer than said desired small-size particle classification;

providing a cyclone separator whose waste discharge content can be adjusted to include particles having a size smaller than said desired small-size particle classification;

subsequently subjecting said toner particles to the influence of said cyclone separator; and adjusting the efficiency of said cyclone separator to discharge as waste discharge those toner particles having substantially said size smaller than said desired small-size particle classification.

2. The method of claim 1 wherein the step of adjusting the efficiency of said cyclone separator comprises the step of changing the separator's exit-duct length in order to control the size toner particle which is retained at the small-size end of said range.

3. The method of claim 1 wherein said grinding step is achieved by operation of a jet mill.

4. The method of claim 2 wherein said grinding step is achieved by operation of a jet mill.

5. The method of claim 3 or 4 wherein said grinding step includes the step of subjecting the output of the jet mill to a coarse classification step, having a first output which comprises substantially said desired large-size particle classification and finer particles, and a second output or larger size which is then reintroduced to the jet mill for further grinding.

* * * * *